US009846390B2

(12) United States Patent
Yamashita

(10) Patent No.: US 9,846,390 B2
(45) Date of Patent: Dec. 19, 2017

(54) TONER CONVEYING DEVICE AND IMAGE FORMING APPARATUS

(71) Applicant: KYOCERA Document Solutions Inc., Osaka (JP)

(72) Inventor: Kazuya Yamashita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/467,358

(22) Filed: Mar. 23, 2017

(65) Prior Publication Data

US 2017/0293242 A1 Oct. 12, 2017

(30) Foreign Application Priority Data

Apr. 12, 2016 (JP) ..... 2016-079665

(51) Int. Cl.
*G03G 15/08* (2006.01)
*G03G 21/10* (2006.01)

(52) U.S. Cl.
CPC ..... *G03G 15/0891* (2013.01); *G03G 21/105* (2013.01); *G03G 2215/0852* (2013.01)

(58) Field of Classification Search
CPC ..... G03G 15/0891; G03G 21/105; G03G 2215/0852
See application file for complete search history.

(56) References Cited

U.S. PATENT DOCUMENTS 6,085,062 A * 7/2000 Mizuishi ..... G03G 21/105 399/358
6,266,511 B1 * 7/2001 Murakami ..... G03G 21/105 222/DIG. 1
6,366,755 B1 * 4/2002 Takashima ..... G03G 15/0822 399/254
7,684,730 B2 3/2010 Furuta et al.
8,086,147 B2 12/2011 Furuta et al.
2008/0304868 A1 * 12/2008 Woo ..... B65D 88/68 399/258

(Continued)

FOREIGN PATENT DOCUMENTS

JP 2009-020267 A 1/2009

*Primary Examiner* — Rodney Bonnette
(74) *Attorney, Agent, or Firm* — Studebaker & Brackett PC

(57) ABSTRACT

A toner conveying device includes a toner replenishing tube extended upwardly/downwardly, a loosening member reciprocating upwardly/downwardly inside the replenishing tube, a toner conveying tube, a conveying member and a converting part. The conveying tube is extended in a crossing direction with the replenishing tube and communicates the replenishing tube and a toner containing part. The conveying member is arranged rotatably inside the conveying tube to convey a toner from the toner containing part to the replenishing tube. The converting part converts rotating movement of the conveying member to reciprocating movement of the loosening member. The loosening member includes a straight line portion and a protruded portion. The straight line portion is engaged with the conveying member via the converting part and extended downwardly along the replenishing tube. The protruded portion is continued from a lower end of the straight line portion, and bent and protruded in the crossing direction.

12 Claims, 8 Drawing Sheets

(56) References Cited

U.S. PATENT DOCUMENTS

| | | | | |
|---|---|---|---|---|
| 2010/0119270 | A1* | 5/2010 | Hoshino | G03G 21/105 399/358 |
| 2012/0294654 | A1* | 11/2012 | Ninomiya | G03G 15/0889 399/254 |
| 2017/0277070 | A1* | 9/2017 | Ichikawa | G03G 15/0891 |

* cited by examiner

TONER CONVEYING DEVICE AND IMAGE FORMING APPARATUS

INCORPORATION BY REFERENCE

This application is based on and claims the benefit of priority from Japanese Patent application No. 2016-079665 filed on Apr. 12, 2016, the entire contents of which are incorporated herein by reference.

BACKGROUND

The present disclosure relates to a toner conveying device conveying a toner and an image forming apparatus including this toner conveying device.

An image forming apparatus of an electrographic manner includes a toner conveying device conveying a toner contained in a toner container to a developing device.

For example, the toner conveying device includes a horizontal conveying duct extended in a horizontal direction, a falling toner conveying duct extended in a downward direction from the horizontal conveying duct, a toner conveying member rotatably arranged inside the horizontal conveying duct, and a coil spring arranged in the falling toner conveying duct. The toner is freely fallen inside the falling toner conveying duct. An upper end of the coil spring is relative-rotatably locked on a protruding part formed on a rotation shaft of the toner conveying member. The coil spring reciprocates in upward and downward directions according to rotation of the toner conveying member.

Incidentally, the freely falling toner may be adhered or aggregated on an internal wall face of the falling toner conveying duct. The above-mentioned toner conveying device is configured to restrain adhesion and aggregation of the toner on the internal wall face of the falling toner conveying duct by reciprocating the coil spring in the upward and downward directions.

However, the falling toner may be caught by the spiral coil spring. That is, it is feared that the coil spring becomes an obstacle and resistance against the falling toner.

SUMMARY

In accordance with an embodiment of the present disclosure, a toner conveying device includes a toner replenishing tube, a loosening member, a toner conveying tube, a conveying member and a converting part. The toner replenishing tube is extended in upward and downward directions. The loosening member is provided so as to reciprocate in the upward and downward directions inside the toner replenishing tube. The toner conveying tube is extended in a direction crossing the toner replenishing tube and provided to communicate an upper portion of the toner replenishing tube and a toner containing part containing a replenishment toner. The conveying member is arranged rotatably inside the toner conveying tube to convey the toner from the toner containing part to the toner replenishing tube. The converting part converts rotating movement of the conveying member to reciprocating movement of the loosening member. The loosening member includes a straight line portion and a protruded portion. The straight line portion is engaged with the conveying member via the converting part and extended downwardly along the toner replenishing tube. The protruded portion is continuously provided from a lower end of the straight line portion and formed in a state being bent so as to protrude in a direction crossing the toner replenishing tube.

In accordance with an embodiment of the present disclosure, an image forming apparatus includes the toner conveying device described above and a developing device including a toner replenishment port connected to a lower end of the toner replenishing tube.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference to the drawings, a suitable embodiment of the present disclosure will be described.

Figure 1:
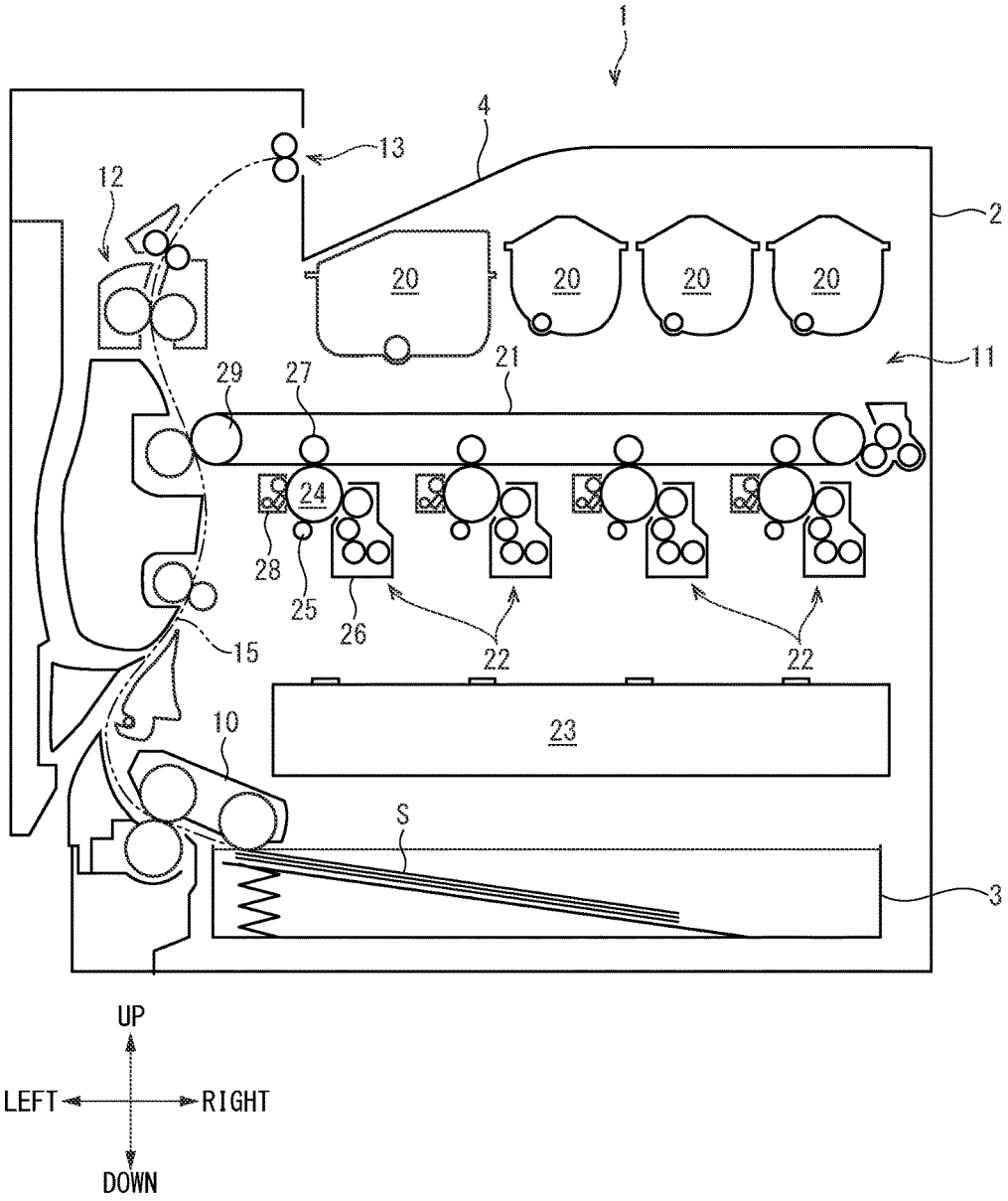
FIG. 1 is a sectional view schematically showing an internal structure of a color printer according to an embodiment of the present disclosure.

With reference to FIG. 1, a color printer 1 as an image forming apparatus according to the embodiment will be described. FIG. 1 is a sectional view schematically showing an internal structure of the color printer 1. Incidentally, hereinafter, it will be described so that the front side of the color printer 1 is positioned at a near side in FIG. 1 and others, and other sides will be based on directions shown in each figure.

The color printer 1 includes an apparatus body 2, a sheet feeding cartridge 3 and an ejected sheet tray 4. The sheet feeding cartridge 3 is attachably/detachably provided in a lower part of the apparatus body 2 formed in a roughly rectangular parallelepiped shape. Inside the sheet feeding cartridge 3, a sheet/sheets S is/are stored. The ejected sheet tray 4 is provided in an upper part of the apparatus body 2. Material of the sheet S is not restricted by a paper, but the sheet S may be a resin film or the like.

The color printer 1 includes a sheet feeding part 10, an image forming part 11, a fixing device 12 and a sheet ejecting part 13 inside the apparatus body 2. The sheet feeding part 10 is arranged at an upstream end of a conveying path 15 extending from the sheet feeding cartridge 3 to the ejected sheet tray 4. The image forming part 11 is arranged at an intermediate stream portion of the conveying path 15. The fixing device 12 is arranged at a downstream side of the conveying path 15. The sheet ejecting part 13 is arranged at a downstream end of the conveying path 15.

The image forming part 11 includes four toner containers 20, an intermediate transferring belt 21, four drum units 22 and an optical scanning device 23. The four toner containers 20 as toner containing parts are arranged in parallel in left and right directions below the ejected sheet tray 4. The intermediate transferring belt 21 is revolvably arranged below the toner containers 20. The four drum units 22 are arranged in parallel in the left and right directions below the intermediate transferring belt 21. The optical scanning device 23 is arranged below the drum units 22.

The four toner containers 20 contain replenishment toners (developers) of four colors (yellow, cyan, magenta, black). Each toner container 20 is attachably/detachably provided with respect to the apparatus body 2. Incidentally, for example, the toner is a two-component developer having a carrier, but is not restricted by this and may be a one-component developer composed of a magnetic toner. The four drum units 22 is configured so as to arrange respective charging devices 25, respective developing devices 26, respective primary transferring rollers 27 and respective cleaning devices 28 around respective photosensitive drums 24. Each photosensitive drum 24 is arranged below each primary transferring roller 27 across the intermediate transferring belt 21. At the left side of the intermediate transferring belt 21, a secondary transferring roller 29 forming a secondary transferring nip is arranged.

The color printer 1 is controlled by a controlling device (not shown) to execute image forming process. That is, each charging device 25 electrically charges a surface of each photosensitive drum 24. The optical scanning device 23 exposes each photosensitive drum 24 to form an electrostatic latent image on the surface of each photosensitive drum 24. Each developing device 26 develops the electrostatic latent image to a toner image by using the toner supplied from each toner container 20. Toner images of four colors carried on four photosensitive drums 24 are primarily transferred onto the intermediate transferring belt 21 in order by the primary transferring rollers 27 having applied bias. Accordingly, toner image of full colors is formed on the intermediate transferring belt 21.

On the other hand, the sheet feeding part 10 feeds the sheet S in the sheet feeding cartridge 3 one by one to the conveying path 15. The toner image carried on the intermediate transferring belt 21 is secondarily transferred onto the sheet S by the secondary transferring roller 29 having applied bias. The fixing device 12 fixes the toner image onto a surface of the sheet S. The sheet ejecting part 13 feeds out the sheet S to the ejected sheet tray 4. Each cleaning device 28 removes a toner remained on a surface of the photosensitive drum 24.

Figure 2:
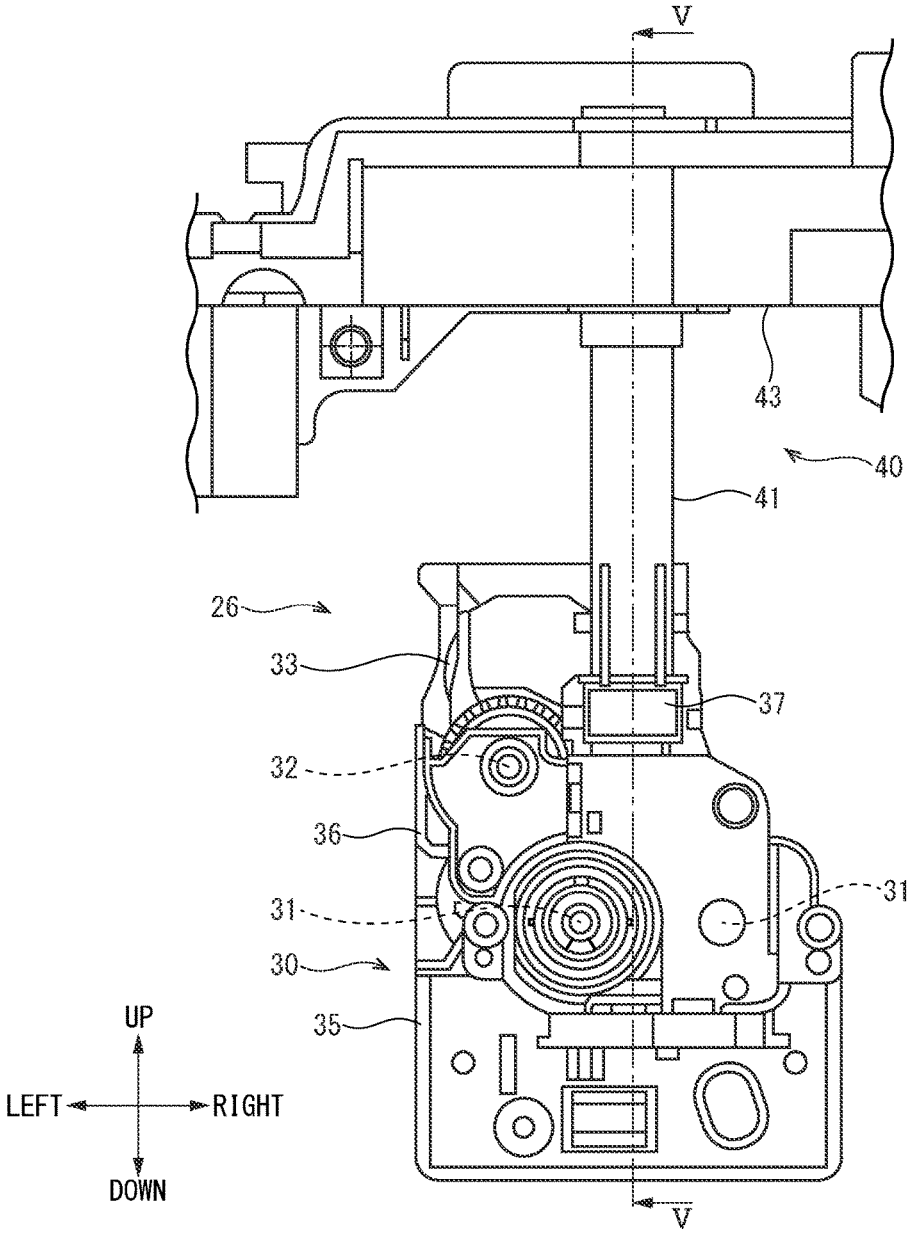
FIG. 2 is a front view showing a developing device in the color printer according to the embodiment of the present disclosure.

Between each of the toner containers 20 and each of the developing devices 26, each of toner conveying devices 40 is provided to convey the toner in each toner container 20 to each developing device 26. Prior to description of the toner conveying device 40, with reference to FIG. 2, the developing device 26 as a toner supply destination will be described. FIG. 2 is a front view showing the developing device 26. Incidentally, because the four developing devices 26 have similar structures, hereinafter, one developing device 26 will be described.

The developing device 26 applies so-called touch-down development system. The developing device 26 includes two mixers 31, a magnet roller 32 and a developing roller 33 inside a case 30. Each mixer 31, the magnet roller 32 and the developing roller 33 are respectively supported by the case 30 so as to rotate around a rotational axis elongated in forward and backward directions. Incidentally, the developing device 26 is provided in the apparatus body 2 so as to be attachable/detachable along a rotational axis direction of the developing roller 33 and others.

The case 30 is formed in a roughly rectangular parallelepiped shape elongated in the forward and backward directions. Inside the case 30, an agitation chamber 35 and a development chamber 36 are formed. The agitation chamber 35 is a space used for agitating the toner. In an upper face of the agitation chamber 35, a toner replenishment port 37 is formed in a roughly rectangular tube shape. The development chamber 36 is formed above the agitation chamber 35 and is a space used for flying the toner to the photosensitive drum 24.

The two mixers 31 are respectively rotated in the agitation chamber 35 to agitate the toner. The magnet roller 32 is arranged above the left mixer 31. The magnet roller 32 is rotated in the development chamber 36 to hold the agitated developer by magnetism. The developing roller 33 is arranged above the magnet roller 32 and rotated in the development chamber 36. The toner held by the magnet roller 32 is moved to the developing roller 33 to form a toner thin layer on a surface of the developing roller 33. The toner is flown from this toner thin layer to the photosensitive drum 24 by an electric potential difference between the developing roller 33 and the photosensitive drum 24. Thereby, the electrostatic latent image on the photosensitive drum 24 is developed to the toner image.

Figure 3:
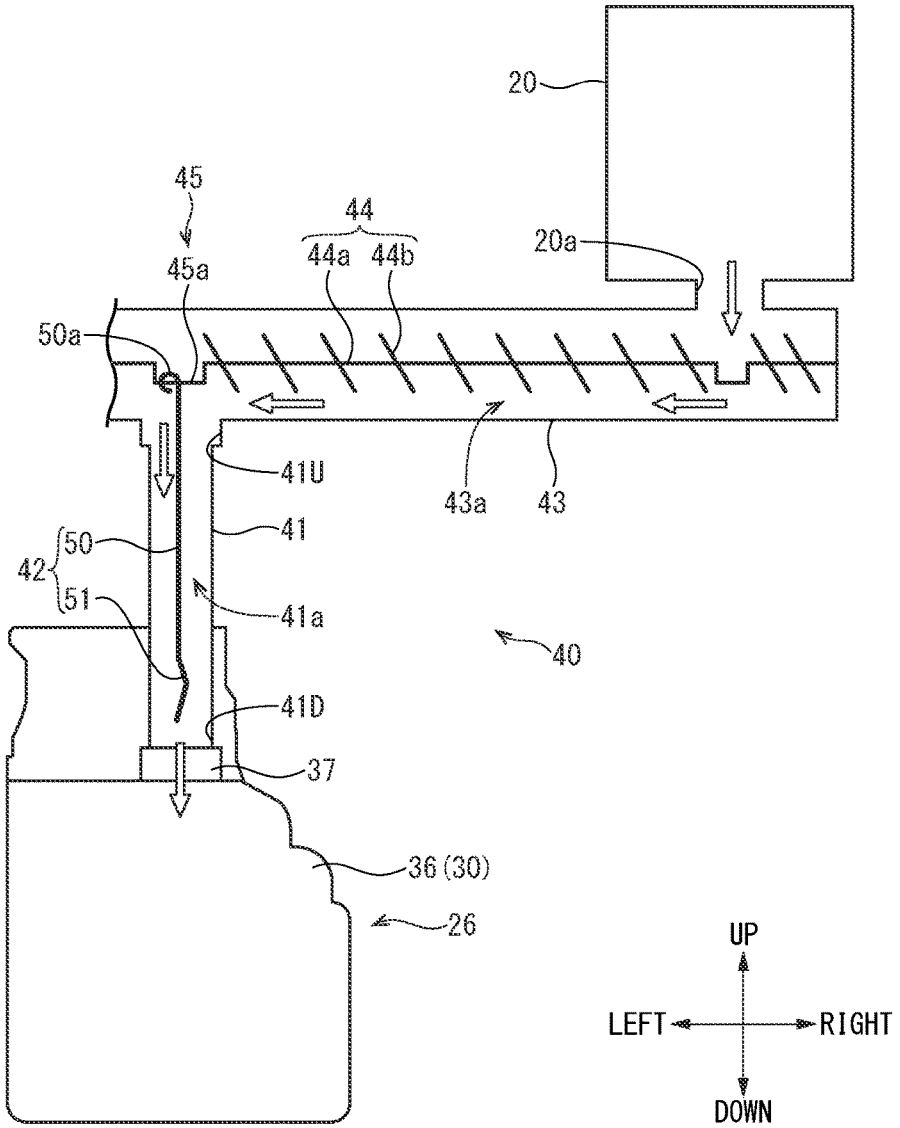
FIG. 3 is a sectional view schematically showing a toner conveying device according to the embodiment of the present disclosure.
Figure 4:
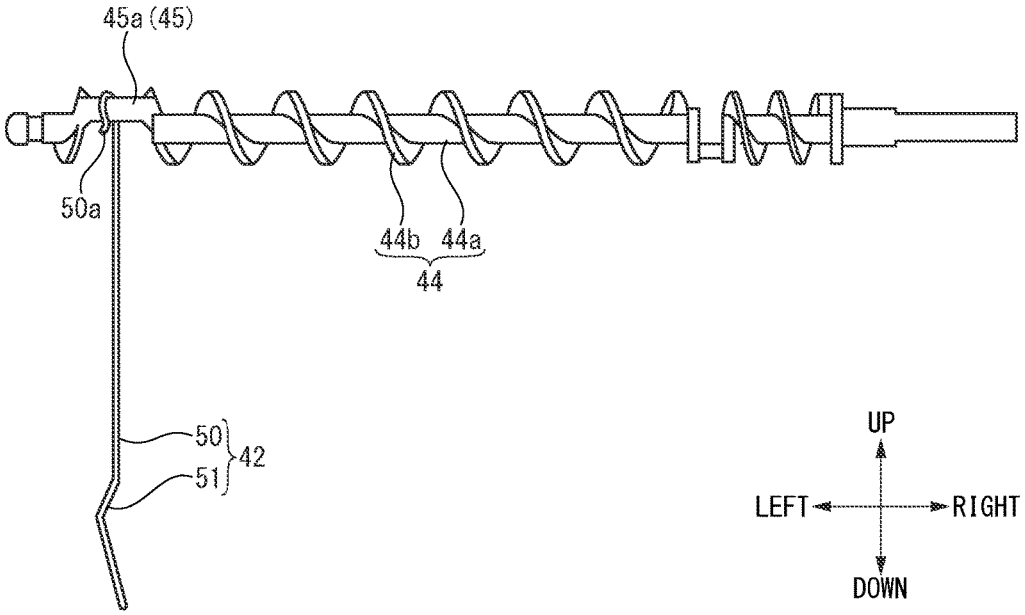
FIG. 4 is a front view showing a loosening member and a conveying screw in the toner conveying device according to the embodiment of the present disclosure.
Figure 5:
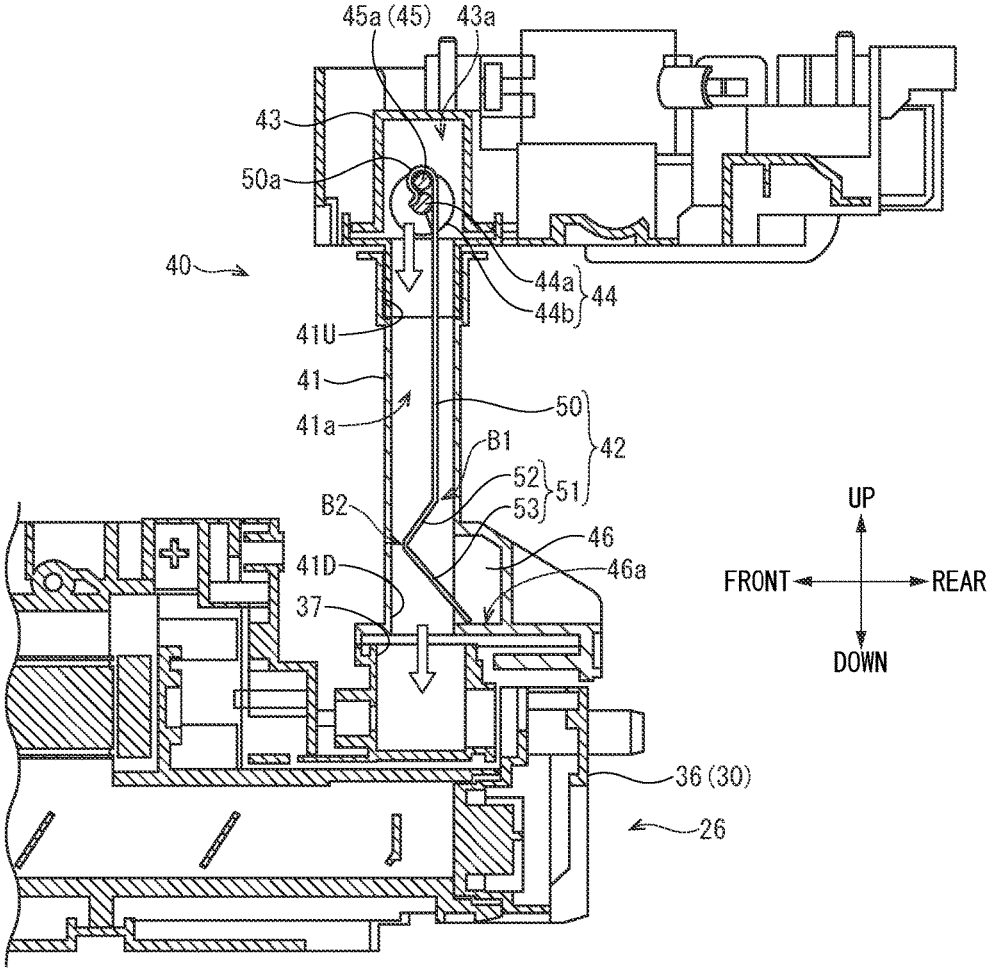
FIG. 5 is a sectional view along a V-V line in FIG. 2.
Figure 6:
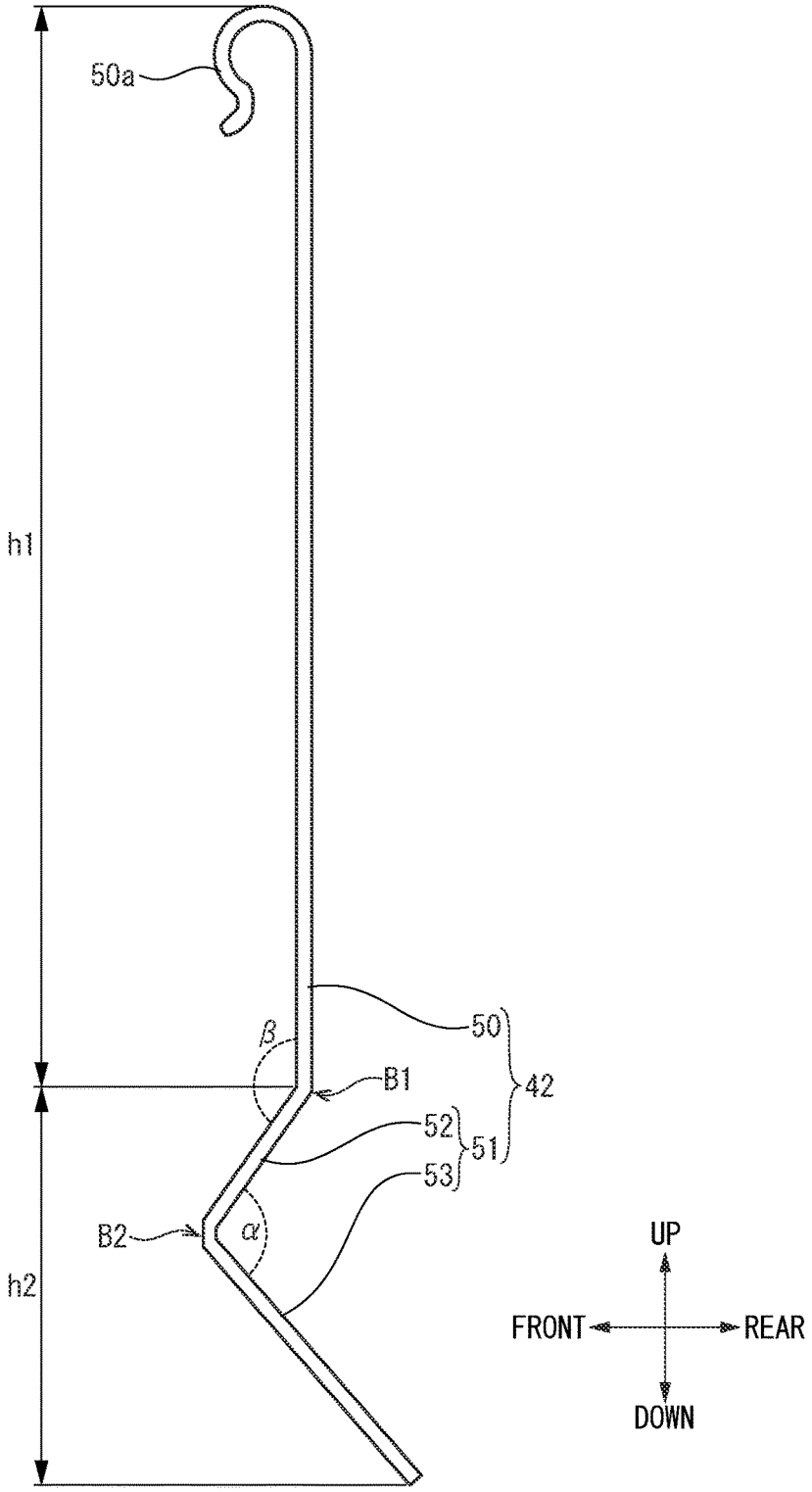
FIG. 6 is a side view showing the loosening member in the toner conveying device according to the embodiment of the present disclosure.
Figure 7:
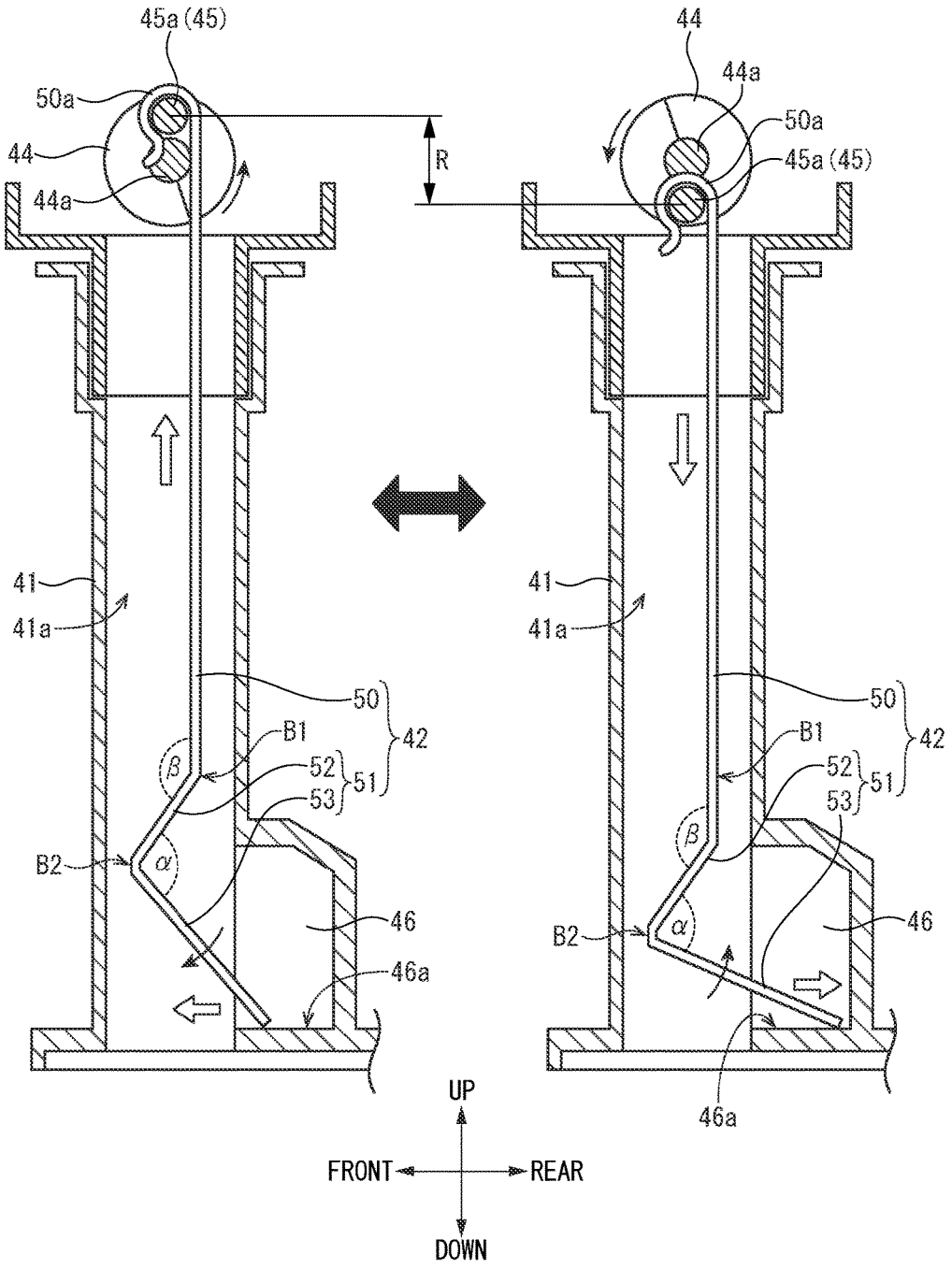
FIG. 7 is a side view used for explaining an operation of the toner conveying device according to the embodiment of the present disclosure.

Next, with reference to FIGS. 3 to 7, the toner conveying device 40 will be described. FIG. 3 is a sectional view schematically showing the toner conveying device 40. FIG. 4 is a front view showing a loosening member 42 and a conveying screw 44. FIG. 5 is a sectional view along a V-V line in FIG. 2. FIG. 6 is a side view showing the loosening member 42. FIG. 7 is a side view used for explaining an operation of the toner conveying device 40. Incidentally, because the four toner conveying devices 40 have similar structures, hereinafter, one toner conveying device 40 will be described.

As shown in FIG. 3, the toner conveying device 40 includes a toner replenishing tube 41, the loosening member 42, a toner conveying tube 43, the conveying screw 44, a converting part 45 and a recess part 46 (refer to FIG. 5).

The toner replenishing tube 41 is formed in a roughly cylindrical shape and extended in upward and downward directions (a vertical direction). A lower end (a lower portion opening 41D) of the toner replenishing tube 41 is connected to the toner replenishment port 37 of the developing device 26. Inside the toner replenishing tube 41, a vertical conveying path 41*a* used for freely falling the toner is formed.

The loosening member 42 is composed of, for example, wire material made of metal, such as stainless steel. The loosening member 42 is arranged inside the toner replenishing tube 41 (the vertical conveying path 41*a*). As described later in detail, the loosening member 42 is provided to loosen (to break) the toner adhered or aggregated on an inner circumference face of the toner replenishing tube 41.

The toner conveying tube 43 is extended in the left and right directions (a direction crossing the toner replenishing tube 41) so as to become roughly horizontal. Moreover, the toner conveying tube 43 is extended so as to be bridged over the four developing devices 26 arranged in the left and right directions in a plane view. The toner conveying tube 43 is provided to communicate an upper portion opening 41U of the toner replenishing tube 41 and a discharge port 20*a* of each toner container 20. Inside the toner conveying tube 43, a horizontal conveying path 43*a* used for conveying the toner from each toner container 20 to the toner replenishing tube 41 is arranged.

As shown in FIGS. 3 and 4, the conveying screw 44 as a conveying member includes a spiral blade 44*b* fixed on an outer circumference face of a rotation shaft 44*a*. The conveying screw 44 is arranged along the toner conveying tube 43 inside the horizontal conveying path 43*a*. The conveying screw 44 is arranged rotatably around an axis inside the toner conveying tube 43. The conveying screw 44 is connected to a drive motor (not shown) via a gear train and others. The conveying screw 44 is rotated around the axis by driving the drive motor to convey the toner from each toner container 20 to the toner replenishing tube 41 (refer to a void arrow in FIG. 3). Incidentally, the drive motor is controlled and driven by a controlling device.

As shown in FIGS. 3 to 5, the converting part 45 includes a crank portion 45*a* arranged at a portion shifted to the outside in a radial direction from the rotation shaft 44*a* of the conveying screw 44. The crank portion 45*a* is formed in a state that a left end of the rotation shaft 44*a* is bent in a roughly U-shape. The crank portion 45*a* is positioned above the toner replenishing tube 41. Incidentally, also in a right end of the rotation shaft 44*a*, a crank shape is formed.

As shown in FIG. 5, the recess part 46 is recessed in a lower portion of the inner circumference face of the toner replenishing tube 41. The recess part 46 is formed in a groove shape elongated in the upward and downward directions at a rear side of the inner circumference face of the toner replenishing tube 41.

Subsequently, with reference to FIGS. 4 to 6, the loosening member 42 will be described. The loosening member 42 is extended over the whole length of the toner replenishing tube 41. The loosening member 42 includes a straight line portion 50 and a protruded portion 51. Incidentally, a length (a height h1) in the upward and downward directions of the straight line portion 50 is longer than a length (a height h2) in the upward and downward directions of the protruded portion 51 (refer to FIG. 6). For example, the straight line portion 50 is formed to be three times higher than the protruded portion 51 (h1=h2*3).

As shown in FIGS. 4 and 5, the straight line portion 50 is formed in a bar shape (a line shape) extending straightly in the vertical direction. In an upper end of the straight line portion 50, a hook portion 50*a* curved so as to be folded back downwardly is formed. The hook portion 50*a* is engaged with the above-described crank portion 45*a* so as to rotate relative to the crank portion 45*a*. The straight line portion 50 is engaged with the conveying screw 44 via the converting part 45 and extended downwardly along the toner replenishing tube 41. The loosening member 42 is arranged so as to hang down from the crank portion 45*a* inside the vertical conveying path 41*a*.

As shown in FIGS. 5 and 6, the protruded portion 51 is continuously provided from a lower end of the straight line portion 50. The protruded portion 51 is formed in a state being bent so as to protrude in the direction crossing the toner replenishing tube 41. The protruded portion 51 is bent in a roughly V-shape and formed so as to be elastically deformable in the upward and downward directions.

In detail, the protruded portion 51 includes a first line portion 52 and a second line portion 53. The first line portion 52 is formed in a state being bent with respect to the straight line portion 50. In FIG. 5 and others, the first line portion 52 is extended from the lower end of the straight line portion 50 in an oblique-forwardly downward direction. The first line portion 52 is formed so as to be bendable in the upward and downward directions around a continuing point (a first bent point B1) with the straight line portion 50. The second line portion 53 is formed in a state being bent in an opposite direction to the first line portion 52 with respect to the first line portion 52. In FIG. 5 and others, the second line portion 53 is extended from a lower end of the first line portion 52 in an oblique-backwardly downward direction. The second line portion 53 is formed so as to be bendable in the upward and downward directions around a continuing point (a second bent point B2) with the first line portion 52. Incidentally, the second line portion 53 is formed slightly longer than the first line portion 52.

As shown in FIG. 5, the second line portion 53 is inserted into the recess part 46 in a state having clearance. A proximal end of the second line portion 53 comes into contact with a lower end face 46*a* of the recess part 46.

Now, an action (an operation conveying the toner) of the toner conveying device 40 will be described.

As shown in FIG. 3, the toner in the toner container 20 is discharged from the discharge port 20*a* into the toner conveying tube 43 (the horizontal conveying path 43*a*). The conveying screw 44 driven and rotated by the drive motor conveys the toner in the horizontal conveying path 43*a* toward the toner replenishing tube 41. The toner conveyed to a downstream side in the horizontal conveying path 43*a* is freely fallen from the upper portion opening 41U of the toner replenishing tube 41 into the vertical conveying path 41*a*. The fallen toner is supplied from the lower portion opening 41D of the toner replenishing tube 41 through the toner replenishment port 37 into the agitation chamber 35. That is, the toner is conveyed in the horizontal conveying path 43*a* and the vertical conveying path 41*a*, and then, replenished to the developing device 26.

Here, the straight line portion 50 of the loosening member 42 is straightly formed in roughly parallel to the toner replenishing tube 41. Therefore, in the toner replenishing tube 41 (the vertical conveying path 41*a*), the straight line portion 50 does not obstruct the freely falling of the toner. Thereby, in the toner replenishing tube 41, it is possible to secure smoothly falling of the toner. Moreover, the protruded portion 51 of the loosening member 42 is protruded in the direction crossing the toner replenishing tube 41. Since the straight line portion 50 does not resist falling the toner, in the vertical conveying path 41*a*, the toner is vigorously fallen, collided with the protruded portion 51 and loosened (dispersed). Thereby, it is possible to prevent the toner from adhering and aggregating on the inner circumference face of the toner replenishing tube 41.

Incidentally, as shown in FIG. 7, if the conveying screw 44 is rotated, the crank portion 45*a* is revolved (eccentrically rotated) along a circular orbit around the rotation shaft 44*a* of the conveying screw 44 positioned away from a centroid of the crank portion 45*a*. According to this, the loosening member 42 engaged with the crank portion 45*a* reciprocates in the upward and downward directions (refer to void arrows in FIG. 7). Incidentally, FIG. 7 illustrates phases of reciprocation (state transition) in the upward and downward directions of the loosening member 42 side by side. As described above, the converting part 45 (the crank portion 45*a*) converts rotating movement of the conveying screw 44 to reciprocating movement of the loosening member 42. By arranging the crank portion 45*a* at a position shifted from the rotational shaft 44*a* to the outside in the radial direction, it is possible to actualize conversion of movement direction.

Moreover, the loosening member 42 is provided so as to reciprocate in the upward and downward directions in a state bringing a lower end of the protruded portion 51 (the second line portion 53) into contact with the lower end face 46*a* of the recess part 46. In detail, in a state that the loosening member 42 (the crank portion 45*a*) is moved at an uppermost position, a lower end of the second line portion 53 comes into contact with the lower end face 46*a* of the recess part 46 (refer to a left illustration in FIG. 7).

In a stage lowering the loosening member 42 (eccentrically rotating the crank portion 45*a*) from the uppermost position to a lowermost position (a stage of state transition from the left illustration to a right illustration in FIG. 7), the lower end of the second line portion 53 is pressed against the lower end face 46*a* of the recess part 46. According to this, the lower end of the second line portion 53 is slidingly moved to a direction away from the toner replenishing tube 41 (in the backward direction) on the lower end face 46*a* of the recess part 46 (refer to a void arrow of the right illustration in FIG. 7). In addition, simultaneously, the protruded portion 51 is elastically deformed in a direction decreasing an angle $\alpha$ between the first line portion 52 and the second line portion 53. That is, because the second line portion 53 receives reaction force from the lower end face 46*a* of the recess part 46, the second line portion 53 is bent so as to approach the first line portion 52. Incidentally, at this time, the protruded portion 51 is elastically deformed also in a direction slightly decreasing an angle $\beta$ between the straight line portion 50 and the first line portion 52. Incidentally, the height h1 of the straight line portion 50 of the loosening member 42 is longer than a movement range (distance) R in the upward and downward directions of the crank portion 45*a*.

In accordance with such a configuration, as the loosening member 42 is lowered, the lower end of the second line portion 53 is moved to the inside of the recess part 46. Therefore, the second bent point B2 overhung to an opposite side to the recess part 46 does not contact with a front side of the inner circumference face of the toner replenishing tube 41 facing to the recess part 46. Thereby, it is possible to smooth reciprocation of the loosening member 42.

On the other hand, in a stage heightening the loosening member 42 (eccentrically rotating the crank portion 45*a*) from the lowermost position to the uppermost position (a stage of state transition from the right illustration to the left illustration in FIG. 7), pressing of the lower end of the second line portion 53 against the lower end face 46*a* of the recess part 46 is released. According to this, the lower end of the second line portion 53 is slidingly moved to a direction approaching the toner replenishing tube 41 (in the forward direction) and the protruded portion 51 is elastically deformed in a direction increasing the angle $\alpha$ by its own elastic force (refer to a void arrow of the left illustration in FIG. 7).

In accordance with the above-described toner conveying device 40, the loosening member 42 is provided to reciprocate in the upward and downward directions inside the toner replenishing tube 41 (the vertical conveying path 41*a*). Moreover, the protruded portion 51 of the loosening member 42 performs bending and stretching motion in the upward and downward directions by reaction force from the lower end face 46*a* of the recess part 46 and its own elastic force. Thereby, in the toner replenishing tube 41, it is possible to loosen the toner and to fall the toner toward the developing device 26. Moreover, since the protruded portion 51 performs bending and stretching motion, it is possible to shake off the toner caught by (adhered on) the protruded portion 51.

Figure 8:
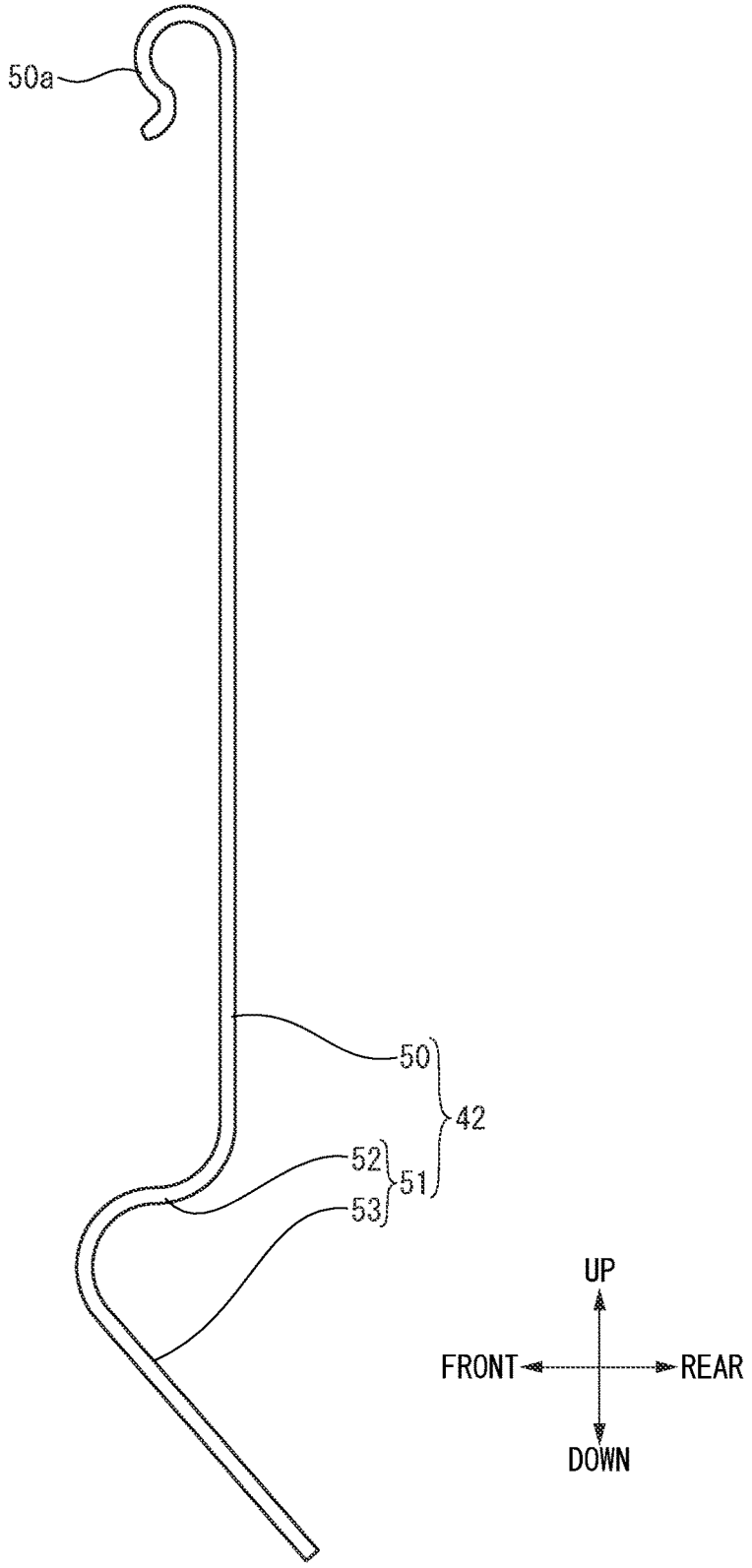
FIG. 8 is a side view showing the loosening member in the toner conveying device as a modified example according to the embodiment of the present disclosure.

Incidentally, although, in the toner conveying device 40 according to the present embodiment, the loosening member 42 is formed by bending the first bent point B1 and the second bent point B2, the present disclosure is not restricted by this. For example, as shown in FIG. 8, the first line portion 52 may be formed in a state curved with respect to the straight line portion 50. Similarly, the second line portion 53 may be formed in a state curved with respect to the first line portion 52. Moreover, in the embodiment, although the protruded portion 51 of the loosening member 42 has the bent points B1 and B2 formed at two positions, it is not restricted by this. The protruded portion 51 may have the bent points formed at three or more positions, but its illustration is omitted.

Incidentally, although, the toner conveying device 40 according to the present embodiment uses the crank portion 45*a* as the converting part 45, the present disclosure is not restricted by this. For example, the converting part 45 may be configured so that an eccentric cam integrally rotating with the conveying screw 44 is brought into contact with an upper end of the loosening member 42. In such a case, it is preferable to provide a biasing member bringing the loosening member 42 into pressure contact with the eccentric cam. Alternatively, a drive source, such as a motor or a solenoid, driven in synchronization with rotation of the conveying screw 44 may be provided and the drive source may make the loosening member 42 reciprocate.

Incidentally, although, in the present embodiment, a case where the present disclosure is applied to the color printer 1 has been described as one example, the disclosure is not restricted by this, but may be applied to a monochrome printer, a facsimile, a multifunction peripheral or the like.

Incidentally, the above-description of the embodiments illustrates one aspect of the toner conveying device and the image forming apparatus including this according to the present disclosure, but the technical scope of the disclosure is not limited to the above-described embodiments. Components in the above-described embodiment can be appropriately exchanged and combined with existing components, and then, the above-description of the embodiments does not limit the content of the disclosure described in the claims.

The invention claimed is:

1. A toner conveying device comprising:

a toner replenishing tube extended in upward and downward directions;

a loosening member provided so as to reciprocate in the upward and downward directions inside the toner replenishing tube;

a toner conveying tube extended in a direction crossing the toner replenishing tube and provided to communicate an upper portion of the toner replenishing tube and a toner containing part containing a replenishment toner;

a conveying member arranged rotatably inside the toner conveying tube to convey the toner from the toner containing part to the toner replenishing tube; and a converting part converting rotating movement of the conveying member to reciprocating movement of the loosening member, wherein the loosening member includes:

a straight line portion engaged with the conveying member via the converting part and extended downwardly along the toner replenishing tube; and a protruded portion continuously provided from a lower end of the straight line portion and formed in a state being bent so as to protrude in a direction crossing the toner replenishing tube.

2. The toner conveying device according to claim 1, wherein the loosening member is composed of wire material extended over the whole length of the toner replenishing tube.

3. An image forming apparatus comprising:

the toner conveying device according to claim 2; and a developing device including a toner replenishment port connected to a lower end of the toner replenishing tube.

4. The toner conveying device according to claim 1 further comprising:

a recess part recessed in a lower portion of an inner circumference face of the toner replenishing tube, wherein the protruded portion is formed so as to be elastically deformable in the upward and downward directions, the loosening member is provided so as to reciprocate in the upward and downward directions in a state bringing a lower end of the protruded portion into contact with a lower end face of the recess part.

5. An image forming apparatus comprising:

the toner conveying device according to claim 4; and a developing device including a toner replenishment port connected to a lower end of the toner replenishing tube.

6. The toner conveying device according to claim 4, wherein the protruded portion includes:

a first line portion formed in a state being bent or curved with respect to the straight line portion; and a second line portion formed in a state being bent or curved in an opposite direction to the first line portion with respect to the first line portion, a lower end of the second line portion comes into contact with the lower end face of the recess part in a state that the loosening member is moved at an uppermost position, in a stage lowering the loosening member from the uppermost position to a lowermost position, the lower end of the second line portion is pressed against the lower end face of the recess part, the lower end of the second line portion is slidingly moved to a direction away from the toner replenishing tube on the lower end face of the recess part, and the protruded portion is elastically deformed in a direction decreasing an angle between the first line portion and the second line portion.

7. An image forming apparatus comprising:

the toner conveying device according to claim 6; and a developing device including a toner replenishment port connected to a lower end of the toner replenishing tube.

8. The toner conveying device according to claim 6, wherein the first line portion is extended from the lower end of the straight line portion in an oblique downward direction and formed so as to be bent in the upward and downward directions around a continuing point with the straight line portion, the second line portion is extended from a lower end of the first line portion in an oblique downward direction and formed so as to be bent in the upward and downward directions around a continuing point with the first line portion.

9. An image forming apparatus comprising:

the toner conveying device according to claim 8; and a developing device including a toner replenishment port connected to a lower end of the toner replenishing tube.

10. The toner conveying device according to claim 1, wherein the converting part includes:

a crank portion arranged at a portion shifted to the outside in a radial direction from a rotation shaft of the conveying member, an upper end of the loosening member engaged with the crank portion rotating around the rotation shaft of the conveying member so as to rotate relative to the crank portion.

11. An image forming apparatus comprising:

the toner conveying device according to claim 10; and a developing device including a toner replenishment port connected to a lower end of the toner replenishing tube.

12. An image forming apparatus comprising:

the toner conveying device according to claim 1; and a developing device including a toner replenishment port connected to a lower end of the toner replenishing tube.

* * * * *